US006987501B2

(12) United States Patent
Takahashi

(10) Patent No.: US 6,987,501 B2
(45) Date of Patent: Jan. 17, 2006

(54) FERROELECTRIC LIQUID CRYSTAL APPARATUS AND METHOD FOR DRIVING THE SAME

(75) Inventor: Rintarou Takahashi, Tokorozawa (JP)

(73) Assignee: Citizen Watch Co., Ltd., Tokyo (JP)

( * ) Notice: Subject to any disclaimer, the term of this patent is extended or adjusted under 35 U.S.C. 154(b) by 575 days.

(21) Appl. No.: 10/252,520

(22) Filed: Sep. 24, 2002

(65) Prior Publication Data

US 2003/0085864 A1 May 8, 2003

(30) Foreign Application Priority Data

Sep. 27, 2001 (JP) ..... 2001-295250

(51) Int. Cl.
*G09G 3/36* (2006.01)
*G09G 5/00* (2006.01)

(52) U.S. Cl. ..... 345/97; 345/211

(58) Field of Classification Search ..... 345/94, 345/95, 96, 97, 208–210, 211
See application file for complete search history.

(56) References Cited

U.S. PATENT DOCUMENTS 4,728,947 A * 3/1988 Ayliffe et al. ..... 345/97
4,733,228 A * 3/1988 Flegal ..... 345/76
5,136,408 A * 8/1992 Okada et al. ..... 349/37
5,459,481 A * 10/1995 Tanaka et al. ..... 345/95
5,684,501 A * 11/1997 Knapp et al. ..... 345/94
5,880,706 A * 3/1999 Nakamura et al. ..... 345/97
6,388,650 B1 * 5/2002 Maltese ..... 345/94
6,417,830 B1 * 7/2002 Byeon, II ..... 345/99
6,720,947 B2 * 4/2004 Yoo et al. ..... 345/97
6,724,360 B2 * 4/2004 Kondoh ..... 345/97
6,741,238 B2 * 5/2004 Choi ..... 345/211
6,750,837 B1 * 6/2004 Kondoh ..... 345/97
2002/0109661 A1 * 8/2002 Blackson et al. ..... 345/97

FOREIGN PATENT DOCUMENTS

JP 62237432 A 10/1987

* cited by examiner

*Primary Examiner*—Xiao Wu
*Assistant Examiner*—M. Fatahiyar
(74) *Attorney, Agent, or Firm*—Finnegan, Henderson, Farabow, Garrett & Dunner, L.L.P.

(57) ABSTRACT

Disclosed are a ferroelectric liquid crystal apparatus using a swing power supply, and a driving method for the ferroelectric liquid crystal apparatus, wherein the pulse duration of a scanning electrode driving waveform is made shorter than the pulse duration of the swing power supply, and the time from the beginning of a pulse trailing edge of the scanning electrode driving waveform to the beginning of a pulse leading edge of the swing power supply is set equal to or shorter than the period during which the pulse trailing edge of the scanning electrode driving waveform rises or falls while describing a time constant curve.

10 Claims, 7 Drawing Sheets

VDD
COMn
VM
VSS t
t1
VDD
COMn2
VM
VSS
t1
t

S1
S4
S3

(SEGb)
+Vd
VM
-Vd
(SEGw)
VM

FERROELECTRIC LIQUID CRYSTAL APPARATUS AND METHOD FOR DRIVING THE SAME

BACKGROUND OF THE INVENTION

1. Field of the Invention

The present invention relates to a ferroelectric liquid crystal apparatus and a method for driving the same and, more particularly, to a ferroelectric liquid crystal apparatus characterized by a driving waveform applied to a scanning electrode of a ferroelectric liquid crystal panel, and a method for driving the same.

2. Description of the Related Art

When a scanning electrode driving circuit for a ferroelectric liquid crystal apparatus is constructed in an integrated circuit form, the chip size becomes larger as the breakdown voltage of the integrated circuit is increased. To address this, it is known to use a swing power supply as a power supply that can substantially halve the breakdown voltage required of the integrated circuit. Swing power supplies are widely employed for use in super twisted nematic (hereinafter abbreviated STN) panels and active matrix panels (called MIM active panels or TFD active panels) having two-terminal switches. An example of application to a ferroelectric liquid crystal panel is described in Japanese Unexamined Patent Publication No. S62-237432.

As will be described in detail later with reference to FIGS. 1 to 7, the driving method of the ferroelectric liquid crystal apparatus has the following problem. That is, as the liquid crystal layer in the ferroelectric liquid crystal panel is thin and the relative permittivity of the ferroelectric liquid crystal is very large, a parasitic load of large capacitance exists on each scanning electrode. As a result, when a swing power supply is used, electric charge stored in a pixel is discharged and a pulse edge describes a time constant curve, causing a significant change in the shape of the driving voltage waveform. When the scanning electrode driving circuit is constructed from an integrated circuit, this change in the driving voltage waveform shape may lead to a breakdown of the integrated circuit.

SUMMARY OF THE INVENTION

In view of the above problem, it is an object of the present invention to provide a ferroelectric liquid crystal apparatus wherein provisions are made to prevent the breakdown of the scanning electrode driving IC when a swing power supply is used, and a driving method for the same.

To attain the above object, according to the present invention, the pulse duration of the scanning electrode driving voltage waveform is made shorter than the pulse duration of the swing power supply, and the time t from the beginning of a pulse trailing edge of the scanning electrode driving voltage waveform to the beginning of a pulse leading edge of the swing power supply is set equal to or longer than the period t1 during which the pulse trailing edge of the scanning electrode driving voltage waveform rises or falls while describing a time constant curve.

DESCRIPTION OF THE PREFERRED EMBODIMENTS

Before describing an embodiment according to the present invention, the related art and its associated disadvantage will be described below with reference to drawings.

When a ferroelectric liquid crystal material in which molecules are aligned in a helical structure is confined between substrates that are separated, for example, by a gap of about 2 $\mu$m, the helical structure is suppressed and the molecules are forced to orient along the substrate surfaces. When the orientation direction is aligned over the entire ferroelectric liquid crystal panel by forming grooves on the substrate surfaces by rubbing or evaporation, the molecules can take one of two different alignment states, depending on an externally applied field.

Figure 1A:
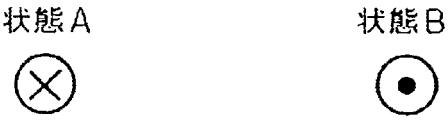
FIG. 1 is a diagram for explaining the alignment of molecules in a ferroelectric liquid crystal panel.
Figure 1B:
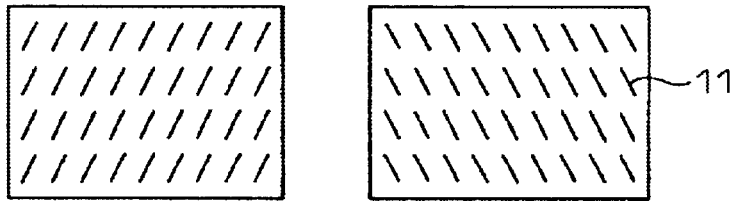
Figure 1C:
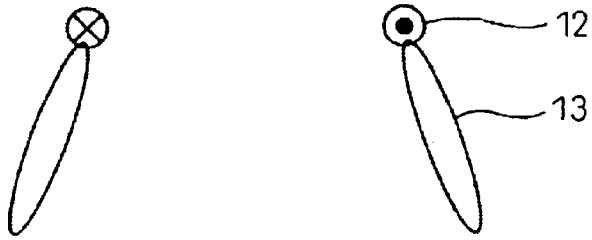

These states will be explained with reference to FIGS. 1A to 1C. In FIGS. 1A to 1C, state A shows the case in which the electric field is directed from the front to the back of the page, while state B shows the case in which the electric field is directed from the back to the front of the page. FIG. 1A shows the directions of the electric fields. FIG. 1B shows the alignment states of the molecules; in the state A, the molecules 11 in the ferroelectric liquid crystal panel are aligned tilting to the right, while in the state B, the molecules 11 are aligned tilting to the left. The resulting states are the two molecular alignment states obtained depending on the direction of the applied electric field. FIG. 1C shows the state of spontaneous polarization 12 of a molecule. In the case of ferroelectric liquid crystal, the spontaneous polarization 12 is perpendicular to the long axis of the molecular 13, and exists at one end of the molecule. In the state A, the spontaneous polarization 12 at the upper end of the rightward tilting molecule 13 is directed from the front to the back of the page, just like the electric field. In the state B, the spontaneous polarization 12 at the upper end of the leftward tilting molecule 13 is directed from the back to the front of the page, just like the electric field. In the ferroelectric liquid crystal panel, the orientation direction of the molecules 11 changes when the direction of the spontaneous polarization 12 is reversed.

Figure 2:
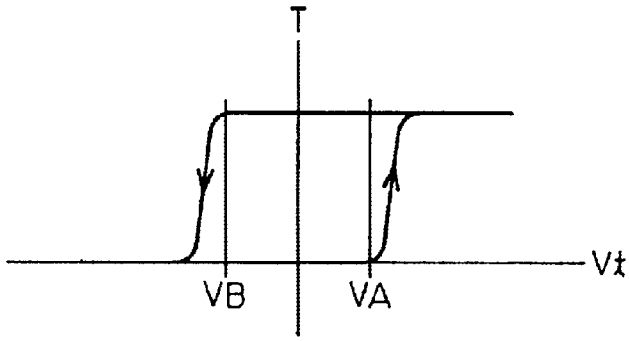
FIG. 2 is a graph showing the hysteresis characteristic of the ferroelectric liquid crystal panel.

In the ferroelectric liquid crystal panel, two polarizers with their polarization axes oriented at right angles to each other are arranged in such a manner as to sandwich transparent substrates therebetween. If the polarization axis of one of the polarizers is made to coincide with the axis of the molecules placed in either one of the alignment states, an optical switch can be constructed that can control transmission/non-transmission of light. In FIG. 1B, suppose that the polarization axis of one of the polarizers is made to coincide with the axis of the molecules placed in the alignment state B; then in the alignment state A, a white display state (ON state) is produced as light is allowed to pass through, while in the alignment state B, a black display state (OFF state) is produced as light is blocked. The characteristic of this optical switch is shown in FIG. 2. The ordinate represents the light transmittance T, and the abscissa represents the product Vt of the voltage V applied between the substrates and time t (hereinafter referred to as "the applied voltage Vt"). When the applied voltage Vt is raised from the black display state where the transmittance is 0, the transmittance T begins to increase when the voltage reaches a threshold value VA, thus making a transition to the white display state. Conversely, when the applied voltage Vt is lowered from the white display state, the transmittance T begins to drop when the voltage reaches a threshold value VB, thus making a transition to the black display state. Because of this hysteresis characteristic, the optical switch has a memory function. That is, with the two threshold values VA and VB defining write and erasure voltages Vt, respectively, the optical switch functions as a memory. If this optical switch is segmented into pixels arranged in a matrix array, and the memory function is utilized, a ferroelectric liquid crystal panel capable of displaying graphics can be obtained. This matrix-type ferroelectric liquid crystal panel will be described below.

Figure 3:
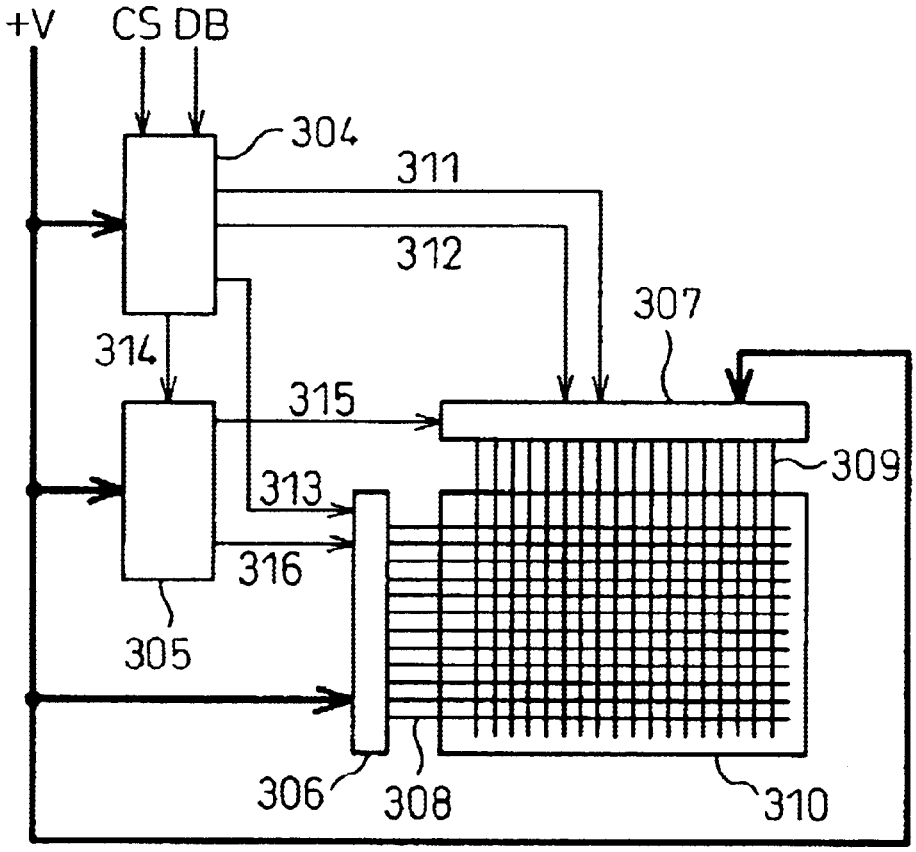
FIG. 3 is a block diagram of a ferroelectric liquid crystal apparatus according to the present invention.

FIG. 3 is a block diagram showing an example of a liquid crystal apparatus constructed using the above ferroelectric liquid crystal panel. Power supply +V supplies a voltage V1 and a ground level voltage to the liquid crystal apparatus. The power supply +V is external to the liquid crystal apparatus, and is connected to a display control circuit 304, an electrode driving voltage generating circuit 305, a scanning electrode driving circuit 306, and a signal electrode driving circuit 307. A control signal group CS is input to the display control circuit 304 from an external central processing unit (CPU). The control signal group CS is a group of signals for controlling the writing and reading of data to and from a display data storing device (hereinafter called the "display RAM") and a driving data storing device (hereinafter called the "instruction register") both contained in the display control circuit 304. A data bus DB denotes data to be written from the CPU to the display RAM or the instruction register, and data to be read into the CPU from the display RAM or the instruction register.

The display control circuit 304 generates a clock using an oscillator (contained in the display control circuit 304) and, based on the clock and the value of the instruction register, outputs display control signals 314, 313, and 312 which are supplied to the electrode driving voltage generating circuit 305, the scanning electrode driving circuit 306, and the signal electrode driving circuit 307, respectively. Further, the display control circuit 304 reads display data 311 from the display RAM and supplies it to the signal electrode driving circuit 307 by using a memory control circuit (contained in the display control circuit 304) operating with the clock.

In response to the display control signal 314, the electrode driving voltage generating circuit 305 supplies the scanning electrode driving circuit 306 and the signal electrode driving circuit 307 with liquid crystal driving voltages 316 and 315 (hereinafter called the "driving voltages") which are applied to a scanning electrode 308 and a signal electrode 309 in the ferroelectric liquid crystal panel 310. The scanning electrode driving circuit 306 creates, from the driving voltage 316 and the display control signal 313, a driving voltage waveform to be applied to the scanning electrode 308. The signal electrode driving circuit 307 creates, from the driving voltage 315, the display control signal 312, and the display data 311, a driving waveform to be applied to the signal electrode 309. The intersection of the scanning electrode 308 and the signal electrode 309 is a pixel.

Figure 4A:
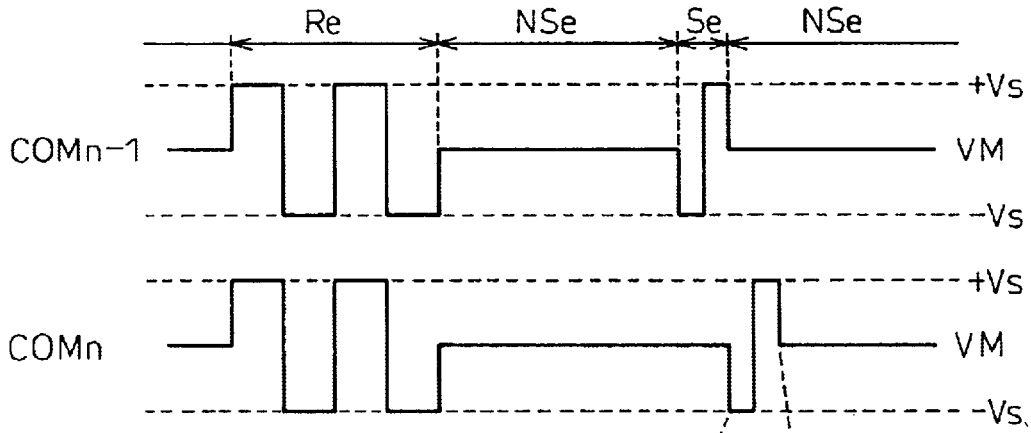
FIG. 4A is a diagram showing driving voltage waveforms to be applied to scanning electrodes according to the conventional art.
Figure 4B:
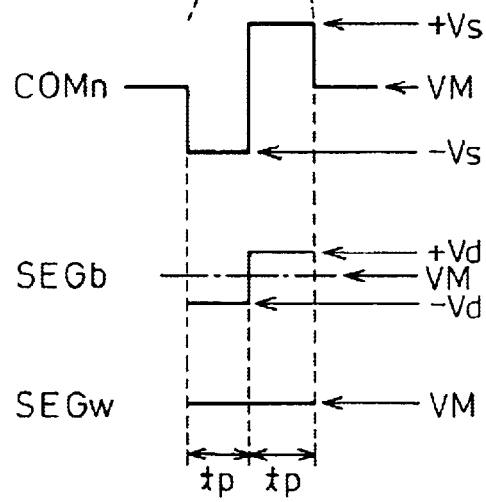
FIG. 4B is a diagram showing driving voltage waveforms to be applied to a signal electrode according to the conventional art.

In the ferroelectric liquid crystal panel, various strategies are employed for the generation of the driving voltage waveforms so that the memory function can be utilized while retaining reliability. FIGS. 4A and 4B show an examples of the driving voltage waveform that serves this purpose. FIG. 4A shows the driving voltage waveforms COMn−1 and COMn to be applied to the (n−1)th scanning electrode and the n-th scanning electrode, respectively. The driving voltage waveforms COMn−1 and COMn both have three value levels, and have a pulse train of long duration at the beginning of voltage application. The driving voltage waveforms COMn−1 and COMn then have a selection pulse of short duration, the selection pulse of the driving voltage waveform COMn−1 being followed by the selection pulse of the driving voltage waveform COMn.

The pulse train of long duration at the beginning is applied to initialize the entire ferroelectric liquid crystal panel before writing data to the ferroelectric liquid crystal panel. During the period of this pulse train (hereinafter called the "reset period (Re)"), the entire ferroelectric liquid crystal panel is forced into the white display state by the application of the first high voltage. Next, the entire ferroelectric liquid crystal panel is switched to the black display state by applying a low voltage. This process is repeated once again to initialize the entire ferroelectric liquid crystal panel to the black display state before writing data. In the ferroelectric liquid crystal panel, a large electric field due to spontaneous polarization is present within the liquid crystal layer, and this electric field causes impurity ions to cluster in a particular section or the layer structure to change. Since this can cause a phenomenon called "image sticking", the pulse train of long duration (product Vt of voltage V and pulse duration t) is applied during the reset period before writing data, thereby causing the impurity ions to be distributed evenly and thus stabilizing the layer structure.

Next, the selection pulse will be explained with reference to FIG. 4B. The selection pulses of the driving voltage waveforms COMn−1 and COMn applied to the respective scanning electrodes each begin with a period (pulse duration tp) during which a low voltage −Vs is applied, which is followed by a period (pulse duration tp) during which a high voltage +Vs is applied (the two periods are together called the "selection period (Se)"). In each of the driving voltage waveforms COMn−1 and COMn, a reference voltage VM of a value intermediate between +Vs and −Vs is applied during a non-selection period (NSe), i.e., the period excluding the selection period.

First, a description will be given for the case where the pixel selected by the driving voltage waveform COMn is displayed in black. The driving voltage waveform SEGb applied to the signal electrode at this time comprises a voltage −Vd in the first half of the selection period and a voltage +Vd in the second half thereof. These voltages +Vd and −Vd are equal in magnitude when referenced to the reference voltage VM in the center. In the first half of the selection period, the voltage applied to the pixel is smaller than the threshold value VA shown in FIG. 2. That is, as the relationship $$(-Vs-(-Vd))\times tp<VA$$

holds, the pixel is maintained in the initialized state, that is, the black display state. In the second half of the selection period, as the voltages +Vs and +Vd are set so that the voltage $$(+Vs-(+Vd))\times tp<VA$$

is applied to the pixel, the display data written to this pixel remains unchanged and the pixel is maintained in the black display state.

In the non-selection period, some other pixel may be displayed in black and, as a result, a pulse of the same shape as the driving voltage waveform SEGb of FIG. 4B (that is, a pulse train whose voltage value alternates between −Vd and +Vd with a duration of tp) may be applied from the signal electrode to the pixel on the n-th scanning electrode. However, in the non-selection period, the reference voltage VM is applied to the pixel on the n-th scanning electrode, and the absolute value of the voltage applied to the pixel (±Vd×tp) is smaller than the threshold value VA, so that the display data written to this pixel remains unchanged. As a result, the pixel is maintained in the black display state. Further, as the voltages applied in the first and second half of the selection period are opposite in sign but equal in magnitude, the applied voltage averages to zero over the entire period consisting of the reset period, the selection period, and the non-selection period, and AC driving is thus accomplished. This serves to eliminate any DC component from the pixel, achieving highly reliable driving.

Next, a description will be given for the case where the pixel selected by the driving voltage waveform COMn is displayed in white. The driving voltage waveform SEGw applied to the signal electrode at this time is held at the center reference voltage VM throughout the selection period. In the first half of the selection period, the voltage applied to the pixel is smaller than the threshold value VA shown in FIG. 2. That is, as the relationship $$(-Vs-VM)\times tp<VA$$

holds, the pixel is maintained in the previous state, that is, the black display state. In the second half of the selection period, since the voltage +Vs is set so that the voltage $$(+Vs-VM)\times tp>VA$$

is applied to the pixel, the pixel changes state and is switched to the white display state. In the non-selection period that follows, some other pixel may be displayed in black and, as a result, a pulse of the same shape as the driving voltage waveform SEGb of FIG. 4B may be applied to the pixel, as noted above. However, in the non-selection period, as the reference voltage VM is applied, the absolute value of the applied voltage (±Vd×tp) is smaller than the absolute value of the threshold value VA or the threshold value VB, so that the display data written to this pixel remains unchanged and the pixel is maintained in the white display state until it is initialized next time. In this case also, AC driving is accomplished.

When the scanning electrode driving circuit 306 shown in FIG. 3 is an integrated circuit (hereinafter called the "scanning electrode driving IC"), a voltage at least as large as $$(+Vs)\times 2$$

is applied to the scanning electrode driving IC. Generally, the chip size of a high voltage IC is large, the chip area being approximately proportional to the square of the required breakdown voltage. For this reason, the scanning electrode driving IC used for the ferroelectric liquid crystal panel has been large in size. To address this, it is known to provide swing power supplies as a method for obtaining driving voltage waveforms such as shown in FIGS. 4A and 4B while reducing the required breakdown voltage by almost one-half.

Figure 5A:
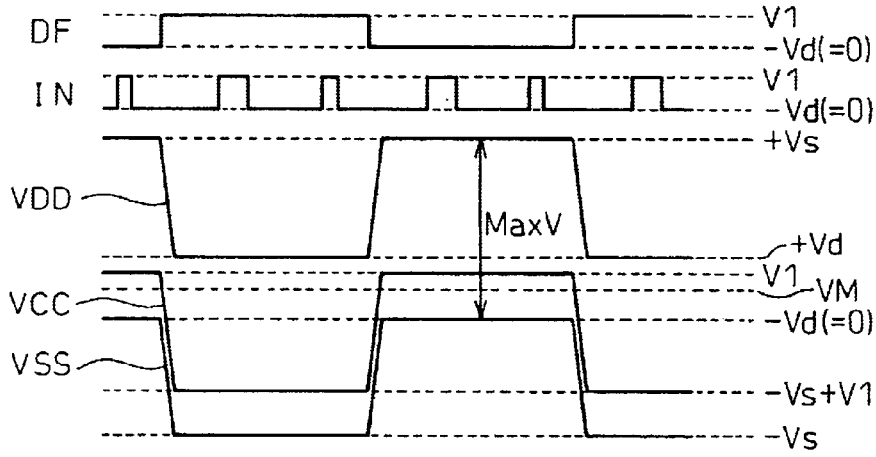
FIG. 5A is a waveform diagram for explaining swing power supplies.
Figure 5B:
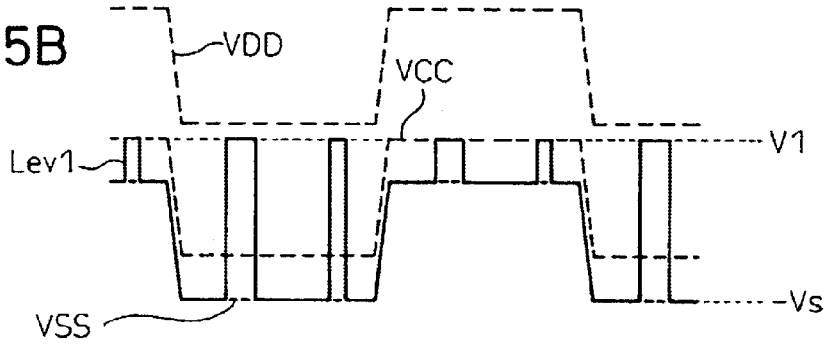
FIGS. 5B and 5C are waveform diagrams for explaining how a signal IN shown in FIG. 5A is shifted from the power supply level of the liquid crystal apparatus to the voltage level of the swing power supply in two steps.
Figure 5C:
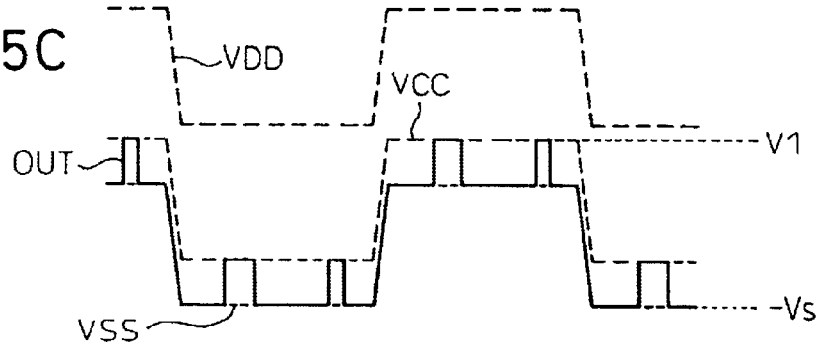

Swing power supplies will be described with reference to the waveform diagrams of FIGS. 5A to 5C. Signal DF is a signal for providing swing timing and polarity to swing power supplies VDD, VCC, and VSS, and is periodically inverted by using one of the signals in the display control signal group 314 of FIG. 3. Signal IN shows an example of another signal in the display control signal group 314. In the signals DF and IN, the high level is defined by the supply voltage V1 of the liquid crystal apparatus shown in FIG. 3, and the low level by the ground level voltage (0 V). In FIG. 5A, the ground level is not specifically shown, as the voltage −Vd is set equal to the ground level. The swing power supply VDD in the upper part is a square wave whose polarity is opposite to that of the signal DF, and has a maximum voltage value of +Vs and a minimum voltage value of +Vd. The swing power supply VCC for logic is a square wave of the same shape as the swing power supply VDD, and its maximum voltage is clamped to the supply voltage V1, while its minimum voltage is −Vs+V1. Likewise, the swing power supply VSS is a square wave of the same shape as the swing power supply VDD, and its maximum voltage is clamped to −Vd, while its minimum voltage is −Vs.

Here, the reference voltage VM provides a reference voltage level in the driving of the ferroelectric liquid crystal panel. FIGS. 5B and 5C are waveform diagrams illustrating how the signal IN is shifted from the power supply level of the liquid crystal apparatus to the swing power supply level in two steps. In the first step, the signal is converted to a signal Lev1 which is driven to the power supply voltage V1 when the control signal IN is high, and to the swing power supply VSS when the signal IN is low. In the second step, the signal Lev1 is converted to a signal OUT which is driven to the swing power supply VCC when the control signal IN is high, and to the swing power supply VSS when the signal IN is low. As the potential difference between the swing power supply VCC and the swing power supply VSS is about 3 V, the control circuit of the scanning electrode driving IC is constructed as a low voltage circuit.

Figure 6A:
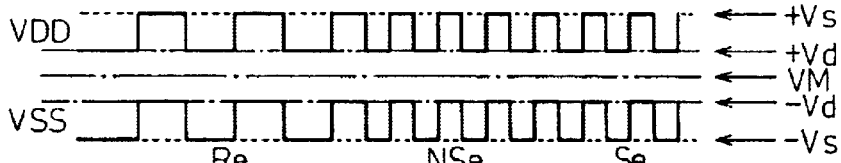
FIGS. 6A and 6B are diagrams illustrating a method of generating the scanning electrode driving voltage waveform COMn shown in FIGS. 4A and 4B.
Figure 6B:
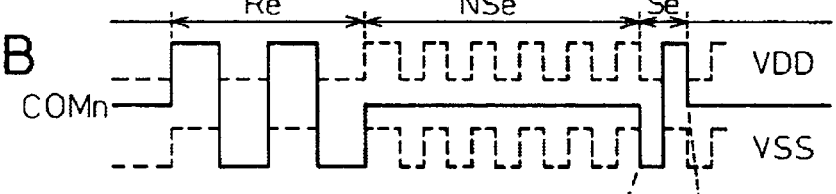

Referring to FIGS. 6A and 6B, a description will be given of how the scanning electrode driving voltage waveform COMn shown in FIGS. 4A and 4B is generated from the swing power supplies VDD and VSS. The relationship between the voltages of the respective swing power supplies is the same as that shown in FIG. 5A. In FIG. 6A, the pulse duration of the swing power supplies VDD and VSS is long in the reset period (Re), but is short in the selection period (Se) where writing is performed. The driving voltage waveform COMn is generated by selecting one voltage from among the swing power supplies VDD and VSS and the center reference voltage VM, based on the control signal applied to the circuit (hereinafter called the "output buffer") that drives the n-th scanning electrode. More specifically, in the reset period, first VDD, then VSS, then again VDD, and finally VSS are selected for the driving voltage waveform COMn in synchronism with the switching between the swing power supplies. In the selection period, VSS is selected in the first half of the period, and VDD in the second half thereof, for the driving voltage waveform COMn. In the other periods, the center reference voltage VM is selected. As a result, the driving voltage waveform COMn in FIG. 6B becomes equal to the driving voltage waveform COMn shown in FIG. 4A.

Figure 7:
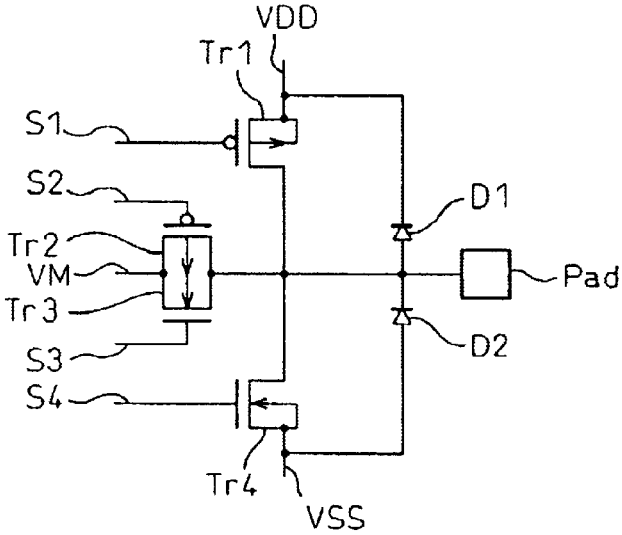
FIG. 7 is a diagram showing the configuration of an output buffer.

FIG. 7 is a diagram showing the configuration of the n-th output buffer. This output buffer is provided in the scanning electrode driving circuit 306 of FIG. 3. A P-type transistor Tr1 is connected at its source to the swing power supply VDD, and is supplied at its gate with a control signal S1. An N-type transistor Tr4 is connected at its source to the swing power supply VSS, and is supplied at its gate with a control signal S4. A P-type transistor Tr2 and an N-type transistor Tr3 together form a transmission gate, and their common source is connected to the voltage VM, while their gates are supplied with control signals S2 and S3, respectively. The control signals S2 and S3 are complementary to each other. The drains of the transistors Tr1, Tr2, Tr3, and Tr4 are connected to Pad, and diodes D1 and D2 for a protective circuit are also connected to Pad.

When the transistor Tr1 is caused to conduct by the control signal S1, the swing power supply VDD is output from the Pad, and the swing power supply VDD is thus selected. Likewise, when the transistor Tr4 is caused to conduct by the control signal S4, the swing power supply VSS is selected. When the transistors Tr2 and Tr3 are caused to conduct by the control signals S2 and S3, the reference voltage VM is selected.

As can be seen from FIG. 6A, when the swing power supplies are used, the maximum voltage (MaxV) applied to the scanning electrode driving IC is equal to the difference between the swing power supply VDD and the swing power supply VSS. This difference is designated as MaxV in FIG. 5A. The maximum voltage value of VDD relative to the reference voltage VM is +Vs, and the maximum voltage value of VSS is −Vd; therefore, MaxV is equal to +Vs +Vd. This value is almost one-half of the maximum voltage (+Vs)×2 that would be applied to the scanning electrode driving IC if the swing power supplies were not used. As a result, when the swing power supplies are used, the breakdown voltage required of the scanning electrode driving IC can be reduced to one-half, which means that the chip area can be reduced to about one quarter.

Figure 6C:
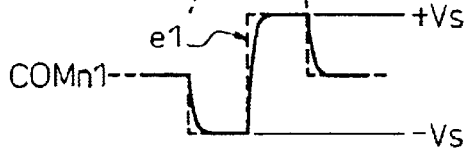
FIG. 6C is a diagram showing a deformed state of the driving voltage waveform shown in FIG. 6B.

In the description given so far, the load of the ferroelectric liquid crystal panel driven by the scanning electrode driving IC has been ignored. This load can be ignored in the case of the earlier mentioned STN panels and two-terminal type active panels. However, in the case of the ferroelectric liquid crystal panel, as the liquid crystal layer is as thin as about 2 μm and the relative permittivity of the ferroelectric liquid crystal is very large, as earlier noted, a parasitic load of large capacitance exists on each scanning electrode. This causes the driving waveform to deform significantly. How this occurs will be explained by referring to FIG. 6C. Compared with the waveform (indicated by dashed line) when the panel load is ignored, in the case of the actual driving voltage waveform COMn1 (indicated by solid line) the pulse edge describes a time constant curve as the charge stored on the pixel is discharged. In particular, at the edge e1 rising from the voltage −Vs to the voltage +Vs, the scanning electrode driving IC may break down.

This will be explained with reference to FIG. 7. Immediately after the edge e1, the transistor Tr1 conducts; at this time, the swing power supply VSS is driven to the voltage −Vd. On the other hand, the voltage at the Pad is held close to the voltage −Vs because of the large parasitic capacitance described above. As a result, current flows to the diode D2 as well as the transistor Tr1. In particular, the voltage between the source and drain of the transistor Tr1 increases to (+Vs)×2, producing a potential difference far exceeding the breakdown voltage; when the current flows in this condition, the temperature rises rapidly, and Tr1 becomes most susceptible to breakdown. This is true not only in the selection period but also in the reset period. In the reset period, the transistor Tr4 may also break down at the edge where the driving voltage waveform COMn changes from the voltage +Vs to the voltage −Vs.

Figure 8A:
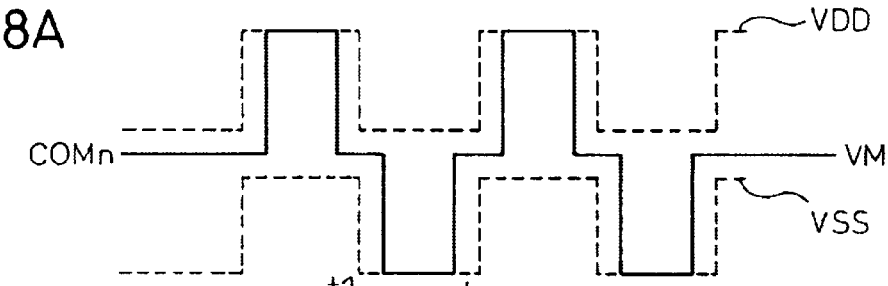
FIGS. 8A to 8C are diagrams showing driving voltage waveforms according to the present invention.
Figure 8B:
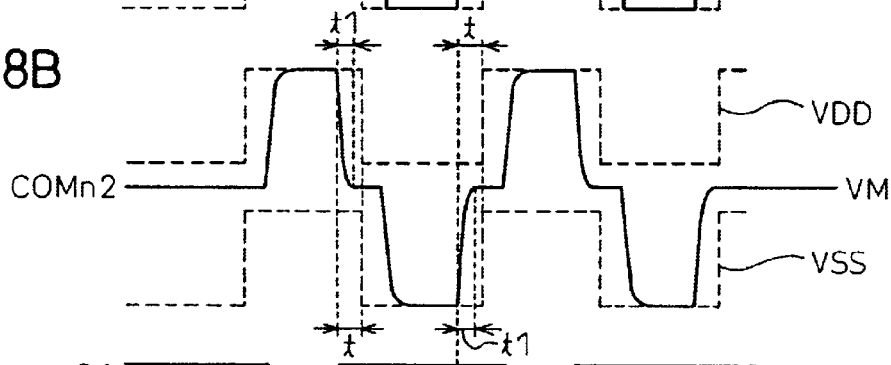
Figure 8C:
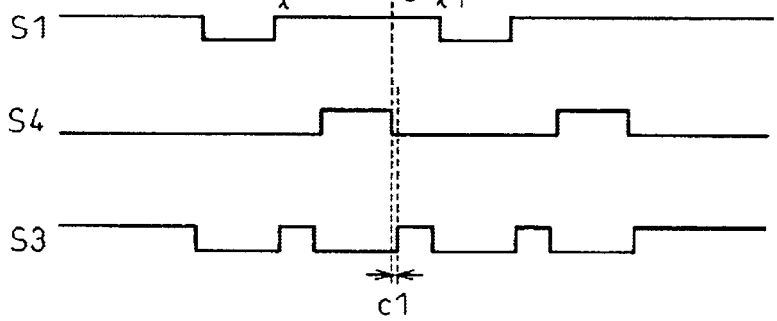

An embodiment of the present invention will be described below with reference to FIGS. 8A to 8C and 9A to 9D. FIGS. 8A to 8C are waveform diagrams for the reset period (Re), wherein FIG. 8A shows the driving voltage waveform COMn according to the present invention which the n-th output buffer outputs when no load is present. FIG. 8B shows the driving voltage waveform COMn2 according to the present invention which the n-th output buffer connected to the scanning electrode outputs in the presence of a capacitive load. FIG. 8C shows the control signals for the n-th output buffer.

Figures 9A, 9B, 9C, 9D:
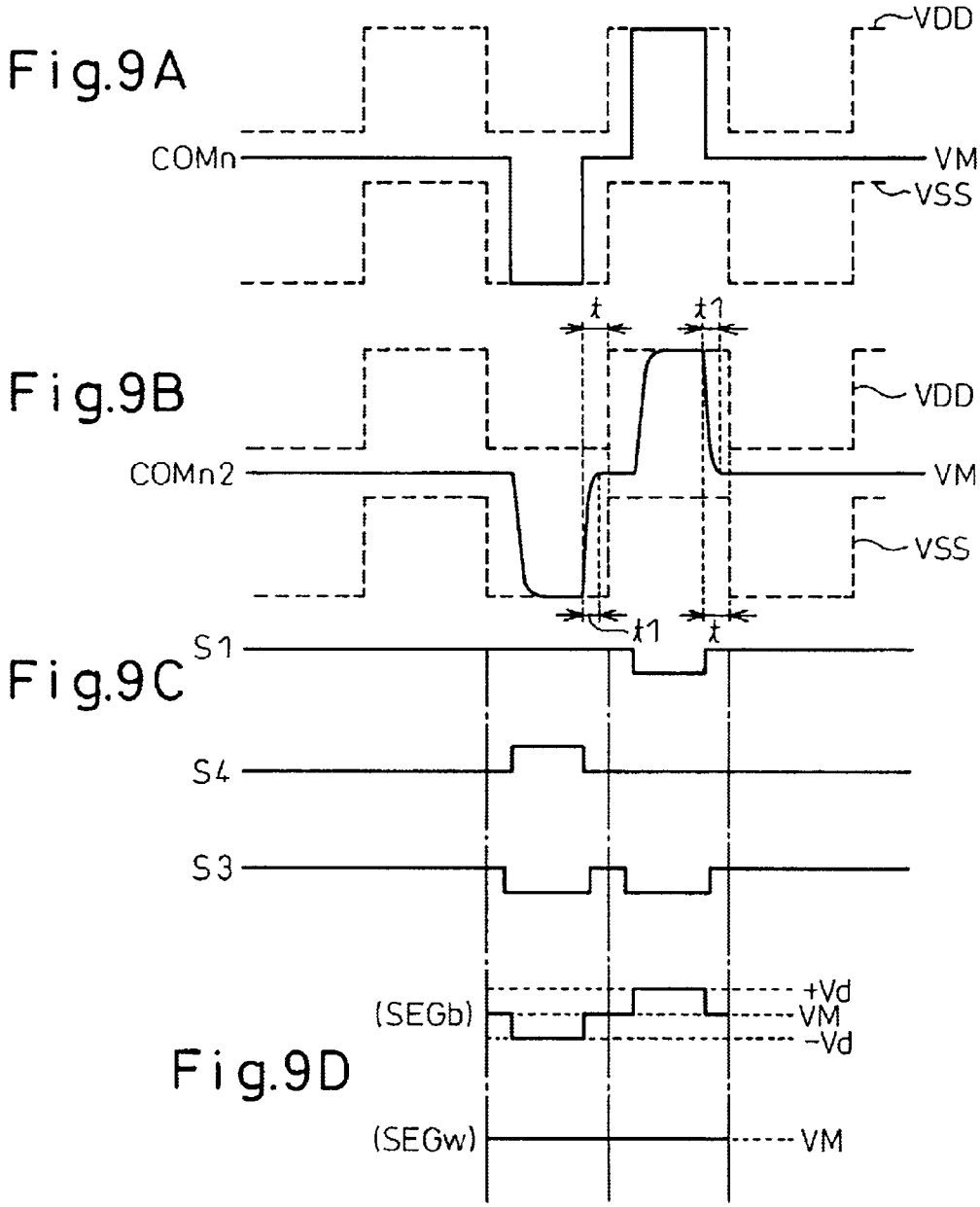
FIGS. 9A to 9D are diagrams showing driving voltage waveforms according to the present invention.

FIGS. 9A to 9D are waveform diagrams for the selection period, wherein FIG. 9A shows the driving voltage waveform COMn according to the present invention which the n-th output buffer outputs when no load is present. FIG. 9B shows the driving voltage waveform COMn2 according to the present invention which the n-th output buffer connected to the scanning electrode outputs in the presence of a capacitive load. FIG. 9C shows the control signals for the n-th output buffer. FIG. 9D shows signal electrode driving voltage waveforms. Though the output buffer contained in the scanning electrode driving IC as an integrated circuit is the same as that shown in FIG. 7, the driving voltage waveform COMn2 is different in shape because the control signals differ from the previously shown ones. However, as the output buffer of the same circuit configuration is used, the same symbols as those in FIGS. 6A to 6B and FIG. 7 are used for the explanation of FIGS. 8A to 8C and 9A to 9D.

First, referring to FIGS. 8A to 8C, the waveforms in the reset period will be described. In FIG. 8A, the leading edge rise timing of the first pulse of the driving voltage waveform COMn is delayed with respect to the corresponding rise timing of the swing power supply VDD, while the trailing edge fall timing is advanced with respect to the corresponding fall timing of the swing power supply VDD. In the second pulse, on the other hand, the leading edge fall timing is delayed with respect to the corresponding fall timing of the swing power supply VSS, while the trailing edge rise timing is advanced with respect to the corresponding rise timing of the swing power supply VSS. The third and fourth pulses are respectively the same as the first and second pulses. In this way, the pulse duration of the scanning electrode driving voltage waveform COMn is made shorter than the swing period (pulse duration) of each of the swing power supplies VDD and VSS.

The driving voltage waveform COMn2 of FIG. 8B is deformed compared with the driving voltage waveform COMn of FIG. 8A because of the presence of a capacitive load on the scanning electrode. In the driving voltage waveform COMn2, the first pulse of positive polarity rises with its leading edge describing a time constant curve which is determined by the transistor Tr1 and the capacitive load on the scanning electrode, and the trailing edge falls over a period t1 while describing a time constant curve which is determined by the transistors Tr2 and Tr3 and the capacitive load on the scanning electrode. In this case, the driving voltage waveform COMn2 falls back to the reference voltage VM before the swing power supply VDD begins to fall. That is, the next pulse of the swing power supply begins after the completion of the period t1 during which the pulse trailing edge of the driving voltage waveform COMn2 falls while describing a time constant curve. In other words, the time t from the beginning of the pulse trailing edge of the driving voltage waveform COMn2 to the beginning of the pulse leading edge of the swing power supply is set equal to or longer than the period t1 during which the pulse trailing edge of the driving voltage waveform COMn2 falls while describing a time constant curve. More specifically, the next pulse of the swing power supply begins after the driving voltage waveform COMn2, whose pulse trailing edge is deformed because of the time constant curve, has fallen back to the constant value VM. Here, the time t may be made substantially equal to the period t1 of the time constant curve. That is, $t \geqq t1$. However, the effect of the time constant curve can be further reduced by setting $t>t1$.

Likewise, the second pulse of negative polarity falls with its leading edge describing a time constant curve which is determined by the transistor Tr4 and the capacitive load on the scanning electrode, and the trailing edge rises over the period ti while describing a time constant curve which is determined by the transistors Tr2 and Tr3 and the capacitive load on the scanning electrode. In this case, the driving voltage waveform COMn2 rises back to the voltage VM before the swing power supply VSS begins to rise. The third and fourth pulses are respectively the same as the first and second pulses.

FIG. 8C shows the waveforms of the control signals S1, S3, and S4 in FIG. 7. The transistor Tr1 conducts when the control signal S1 is low. The transistor Tr4 conducts when the control signal S4 is high. The transmission gate constructed from the transistors Tr2 and Tr3 conducts when the control signal S3 is high. The control signal S2 is not shown here as it is complementary to the control signal S3. The control signal S3 goes high during a period between the edges of the swing power supplies VDD and VSS, that is, between the positive pulse and negative pulse of the driving voltage waveform COMn, and causes the reference voltage VM to be output from the Pad.

In this way, the time t from the beginning of the trailing edge of each pulse of the driving voltage waveform COMn in the absence of a load to the beginning of the corresponding edge of the swing power supply VDD or VSS is set equal to or longer than the period t1 of the time constant curve, that is, the charge/discharge time determined by the capacitive load on the scanning electrode and the performance of the respective transistors ($t \geqq t1$). As can be seen from the driving voltage waveform COMn2 of FIG. 8B, the time t is set as described above, even when the pulse edge is affected by the time constant curve, the corresponding pulse edge of the swing power supply appears after the pulse edge of the driving voltage waveform COMn2 has fallen or risen back to the reference voltage VM; as a result, when switching is done from the swing power supply VSS to the swing power supply VDD or vice versa, the current does not flow to the transistor Tr1 or Tr4 under the condition of a potential difference exceeding the transistor's breakdown voltage.

In FIG. 8C, a shoot-through current elimination period c1 is provided to introduce a trace delay between the falling edge of the control signal S4 and the rising edge of the control signal S3. This period c1 is provided to ensure that the transmission gate constructed from the transistors Tr2 and Tr3 is caused to conduct after the transistor Tr4 has been fully turned off, thereby eliminating an unwanted shoot-through current that could cause an increase in power consumption or a breakdown of the IC; here, the delay is introduced using a delay circuit contained in the scanning electrode driving IC. A trace delay for eliminating a shoot-through current between the transistor Tr1 and the transmission gate is also provided to ensure that one is turned on after the other has been turned off.

Next, the waveforms in the selection period (Se) will be described with reference to FIGS. 9A to 9D. The pulse duration of each swing power supply is shown as being substantially the same as that in the reset period (Re) shown in FIG. 8A but, actually, the pulse duration of each swing power supply is shorter in the selection period (Se) than in the reset period (Re), as previously shown in FIGS. 4A and 4B. However, the time constant curve occurs in the selection period (Se) as well as in the reset period (Re). In FIG. 9A, the selection pulse of the driving voltage waveform COMn consists of a negative pulse and a positive pulse. In the negative pulse in the first half of the period, the fall timing of the leading edge is delayed with respect to the fall timing of the swing power supply VSS, and the rise timing of the trailing edge is advanced with respect to the rise timing of the swing power supply VSS. In the positive pulse in the second half of the period, the rise timing of the leading edge is delayed with respect to the rise timing of the swing power supply VDD, and the fall timing of the trailing edge is advanced with respect to the fall timing of the swing power supply VDD. That is, the pulse duration of the driving voltage waveform COMn is shorter than the pulse duration of each swing power supply.

The driving voltage waveform COMn2 shown in FIG. 9B is deformed compared with the driving voltage waveform COMn of FIG. 9A because of the presence of a capacitive load on the scanning electrode. Like the deformed waveform in the reset period shown in FIG. 8B, the waveform in the selection period shown in FIG. 9B is deformed with its pulse leading and trailing edges describing time constant curves similar to those shown in FIG. 8B. FIG. 9C shows the waveforms of the control signals S1, S3, and S4 in FIG. 7. These control signals are the same, in operation, as the signals shown in FIG. 8C.

FIG. 9D shows the voltage waveforms applied to the signal electrode. To maintain the black display state, the driving voltage waveform SEGb is applied to the signal electrode, and to switch to the white display state, the driving voltage waveform SEGw is applied. As shown in FIG. 9D, the pulse duration of the driving voltage waveform SEGb, like the driving voltage waveform COMn shown in FIG. 9B, is made shorter than the pulse duration of each of the swing power supplies VDD and VSS, and the level before and after the edges is held at the voltage VM. By setting the waveform in this way, derivative noise, which occurs when switching the signal electrode driving voltage waveform and propagates to the scanning electrode by capacitive coupling, is shifted from the timing for switching between the swing power supplies VDD and VSS, thereby preventing the breakdown or malfunction of the scanning electrode driving IC.

Compared with an STN panel, a very large capacitive load occurs in the ferroelectric liquid crystal and, in the reset period and the selection period, a negative pulse is immediately followed by a positive pulse; as a result, if swing power supplies are used in the same manner as in the prior art, the scanning electrode driving IC will break down. The reason that, in the present invention, the pulse duration of the scanning electrode driving voltage waveform is made shorter than the pulse duration of the swing power supply is not to correct the deformation of the driving waveform, but to ensure that, even if the pulse edge of the driving voltage waveform is deformed, the driving voltage waveform is brought back to a level substantially equal to the reference voltage, i.e., the center voltage, before the swing power supply changes. This means that the charge flowing backward from the capacitor parasitic on the scanning electrode is brought back to the reference voltage. As a result, if positive and negative pulses appear one followed by the other in the driving voltage waveform, a current that flows from the highest voltage to the lowest voltage does not occur. Accordingly, the present invention can provide a ferroelectric liquid crystal apparatus, and a driving method for the same, that can use a scanning electrode driving IC whose required breakdown voltage is reduced by the use of a swing power supply, and can yet prevent the breakdown of the IC.

In the above embodiment, the rise timing or fall timing of the pulse leading edge of the driving voltage waveform is delayed with respect to the rise timing or fall timing of the pulse leading edge of the swing power supply. However, it will be appreciated that a similar effect can be obtained if the pulse leading edge of the driving voltage waveform is made to coincide with the pulse leading edge of the swing power supply.

While the present invention has been described by dealing with the driving voltage waveforms applied to the scanning electrode and signal electrode, it will be appreciated that a similar effect can be obtained if the driving apparatus and driving method of the present invention are applied to a "MIM active panel" or "TFD active panel" having two-terminal switches.

What is claimed:

1. A ferroelectric liquid crystal apparatus having one scanning electrode or two or more scanning electrodes and one signal electrode or two or more signal electrodes between a pair of substrates sandwiching therebetween a ferroelectric liquid crystal, wherein a circuit for generating a driving voltage waveform for said scanning electrode is an integrated circuit, said integrated circuit generates said driving voltage waveform by using a swing power supply, and the pulse duration of said generated driving voltage waveform is shorter than the pulse duration of said swing power supply.

2. A ferroelectric liquid crystal apparatus as claimed in claim 1, wherein time t from the beginning of a pulse trailing edge of said scanning electrode driving voltage waveform to the beginning of a pulse leading edge of said swing power supply is equal to or longer than a period t1 during which the pulse trailing edge of said scanning electrode driving voltage waveform rises or falls while describing a time constant curve.

3. A ferroelectric liquid crystal apparatus as claimed in claim 1, wherein said scanning electrode driving voltage waveform has a positive pulse and a negative pulse, and a period having a voltage value intermediate between the voltage value of said positive pulse and the voltage value of said negative pulse is provided between said positive pulse and said negative pulse.

4. A ferroelectric liquid crystal apparatus as claimed in claim 3, wherein a shoot-through current elimination period is provided within the trailing edge of said scanning electrode driving voltage waveform.

5. A ferroelectric liquid crystal apparatus as claimed in claim 1, wherein the pulse duration of a driving voltage waveform for said signal electrode is also shorter than the pulse duration of said swing power supply.

6. A driving method for a ferroelectric liquid crystal apparatus having one scanning electrode or two or more scanning electrodes and one signal electrode or two or more signal electrodes between a pair of substrates sandwiching therebetween a ferroelectric liquid crystal, wherein a circuit for generating a driving voltage waveform for said scanning electrode is an integrated circuit, said driving voltage waveform is generated by using a swing power supply, and when generating said driving voltage waveform, the pulse duration of said driving voltage waveform is made shorter than the pulse duration of said swing power supply.

7. A driving method for a ferroelectric liquid crystal apparatus as claimed in claim 6, wherein time t from the beginning of a pulse trailing edge of said scanning electrode driving voltage waveform to the beginning of a pulse leading edge of said swing power supply is set equal to or longer than a period t1 during which the pulse trailing edge of said scanning electrode driving voltage waveform rises or falls while describing a time constant curve.

8. A driving method for a ferroelectric liquid crystal apparatus as claimed in claim 6, wherein said scanning electrode driving voltage waveform has a positive pulse and a negative pulse, and a period having a voltage value intermediate between the voltage value of said positive pulse and the voltage value of said negative pulse is provided between said positive pulse and said negative pulse.

9. A driving method for a ferroelectric liquid crystal apparatus as claimed in claim 8, wherein a shoot-through current elimination period is provided within the trailing edge of said scanning electrode driving voltage waveform.

10. A driving method for a ferroelectric liquid crystal apparatus as claimed in claim 6, wherein the pulse duration of a driving voltage waveform for said signal electrode is also shorter than the pulse duration of said swing power supply.

* * * * *